US007255602B1

(12) United States Patent
Driessen et al.

(10) Patent No.: US 7,255,602 B1
(45) Date of Patent: Aug. 14, 2007

(54) SHIELDING FOR ELECTRICAL CABLE ASSEMBLIES

(75) Inventors: Darin R. Driessen, West Bend, WI (US); Eugene W. Dolfi, Rockford, IL (US); Michael A. Seno, Cherry Valley, IL (US); Jack S. Canciamille, Stillman Valley, IL (US)

(73) Assignee: Hamilton Sundstrand Corporation, Rockford, IL (US)

( * ) Notice: Subject to any disclaimer, the term of this patent is extended or adjusted under 35 U.S.C. 154(b) by 0 days.

(21) Appl. No.: 11/591,783

(22) Filed: Nov. 2, 2006

(51) Int. Cl.
*H01R 9/03* (2006.01)

(52) U.S. Cl. ..... 439/610

(58) Field of Classification Search ..... 439/610, 439/98, 579
See application file for complete search history.

(56) References Cited

U.S. PATENT DOCUMENTS

| | | | | |
|---|---|---|---|---|
| 4,166,921 | A | 9/1979 | Phillips et al. | |
| 4,639,544 | A | 1/1987 | Dableh et al. | |
| 5,329,605 | A | 7/1994 | Wargotz | |
| 5,431,759 | A | 7/1995 | Neuroth | |
| 5,496,968 | A | 3/1996 | Katoh et al. | |
| 5,508,475 | A | 4/1996 | Profiri et al. | |
| 5,521,331 | A | 5/1996 | Hillburn | |
| 5,656,796 | A | 8/1997 | Marinos et al. | |
| 5,739,471 | A | 4/1998 | Burisch | |
| 5,945,631 | A | 8/1999 | Henrikson et al. | |
| 6,005,191 | A | 12/1999 | Tzeng et al. | |
| 6,188,025 | B1 | 2/2001 | Hanai et al. | |
| 6,227,881 | B1 | 5/2001 | Tharp et al. | |
| 6,249,913 | B1 | 6/2001 | Galipeau et al. | |
| 6,255,591 | B1 | 7/2001 | Ziemek | |
| 6,276,967 | B1 * | 8/2001 | Hall | 439/610 |
| 6,310,286 | B1 | 10/2001 | Troxel et al. | |
| 6,339,193 | B1 * | 1/2002 | Goett et al. | 439/610 |
| 6,384,337 | B1 | 5/2002 | Drum | |
| 6,541,706 | B2 | 4/2003 | McLeod | |
| 6,739,883 | B1 | 5/2004 | Cheng et al. | |
| 6,750,399 | B1 | 6/2004 | Daumling | |
| 6,764,350 | B2 * | 7/2004 | Kosmala | 439/610 |
| 6,929,512 | B2 | 8/2005 | Lai | |
| 2005/0056453 | A1 | 3/2005 | Gialenios et al. | |
| 2005/0233610 | A1 | 10/2005 | Tutt et al. | |

* cited by examiner

*Primary Examiner*—Tho D. Ta
(74) *Attorney, Agent, or Firm*—Carlson, Gaskey & Olds

(57) ABSTRACT

An electrical cable assembly is provided including multiple cables having wires. The cables each include a shield. A connector receives ends of the wires and includes an outer surface. A conductive shield ring has an outer periphery and includes multiple holes receiving the cables. The shield of each cable engages an inner surface provided by a corresponding hole in the shield ring. In one example, the circumference of each shield is soldered to the corresponding hole. A wrap engages the outer periphery and the outer surface to electrically connect the connector to the shields. In one example, the wrap is conductive heat shrink wrap that surrounds and engages the entire outer surface of the shield ring.

14 Claims, 1 Drawing Sheet

SHIELDING FOR ELECTRICAL CABLE ASSEMBLIES

BACKGROUND OF THE INVENTION

This invention relates to an apparatus and method for shielding a cable assembly having multiple cables connected to a common connector.

A 1394b data communication bus is capable of transmitting 400 Mbits/sec over copper wire. This type of high speed communication can generate radiated emissions capable of disrupting the performance of electrical assemblies both internal and external to an electrical unit associated with the cable assembly. In one example, the communication signals are carried over multiple ports, for example three ports. Each port is connected to the electrical unit's external connector through a shielded cable. The three cables must meet at the same external connector, which use crimp style pins in one example. The attachment of each port's cable causes a break in the cable shield to allow the wires to enter the rear of the connector. Breaking the shield creates an opening that permits emission outages that may cause a failure in the electrical component. What is needed is an apparatus and method of insuring 360 degree shield coverage at the rear of the connector to eliminate possible outages while maintaining low cost and manufacturability.

SUMMARY OF THE INVENTION AND ADVANTAGES

An electrical cable assembly is provided including multiple cables having wires. The cables each include a shield. A connector receives ends of the wires and includes an outer surface. A conductive shield ring has an outer periphery and includes multiple holes receiving the cables. The shield of each cable engages an inner surface provided by a corresponding hole in the shield ring. In one example, the circumference of each shield is soldered to the corresponding hole. A wrap engages the outer periphery and the outer surface to electrically connect the connector to the shields. In one example, the wrap is conductive heat shrink wrap that surrounds and engages the entire outer surface of the shield ring. In this manner, 360 degrees of each shield is engaged and electrically grounded to 360 degrees of the outer surface of the connector to surround each cable entirely in shielding.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
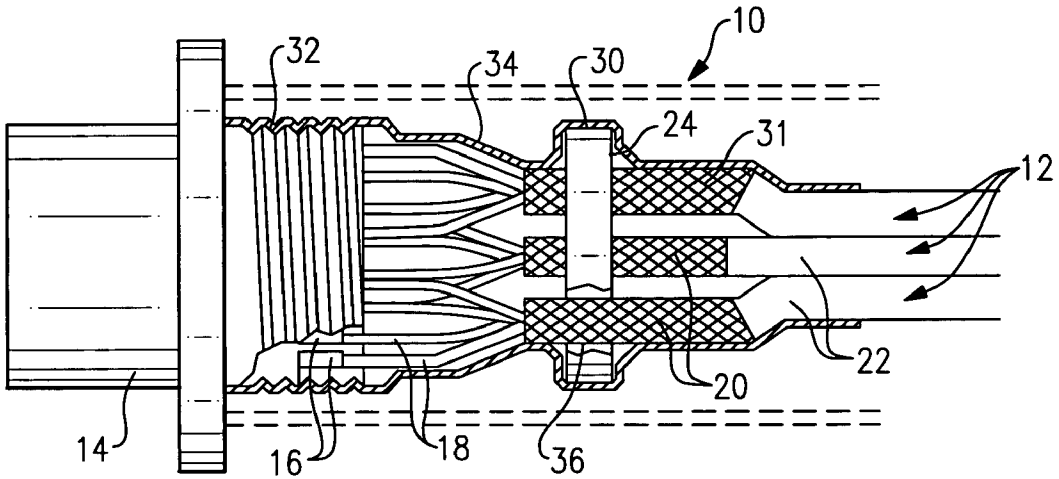
FIG. 1 is a cross-sectional view of an example cable assembly using an example shield ring.
Figure 2:
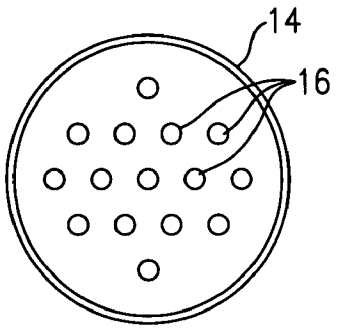
FIG. 2 is an end view of the connector.

FIG. 1 schematically illustrates one example cable assembly 10. The cable assembly 10 includes multiple cables 12. In the example shown, a three port arrangement is provided for a 1394b connector. A common connector 14 is provided for the cables 12 and receives pins 16 that are electrically connected to another connector of an electrical component (not shown). Each cable 12 includes multiple wires 18 each having a pin 16 arranged at its end. An example pin configuration is shown in FIG. 2. The ends of the wires 18 are stripped and the pins 16 are crimped to the ends, as is known. A metallic shield 20, such as a braided shield, surrounds each set of wires 18 for each cable 12, as is known in the art. An external jacket 22 typically surrounds each shield 20 to insulate the shield 20 from the surrounding environment.

Figure 3:
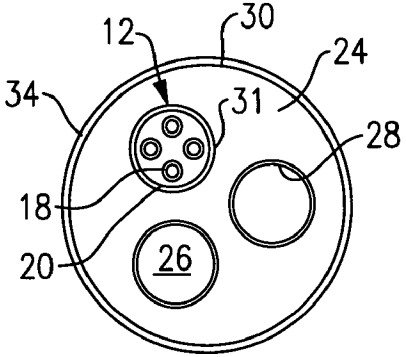
FIG. 3 is an end view of the shield ring with a cable inserted and its shield grounded to the shield ring.

A conductive shield ring 24 is used to prevent any openings that would permit emissions from the rear of the connector 14 as is typical with a multiple cable arrangement. Referring to FIG. 3, the shield ring 24 includes three holes 26 circumferentially spaced from one another for receiving each of the three cables 12. The shield ring 24 can be any suitable shape. In the example, the holes 26 are sized to ensure that the shield 20 is in close proximity to the inner surface 28 provided by the holes 26. The shield 20 can be received in a slip fit or interference relationship relative to the holes 26.

In one example, the shield ring 24 is a copper material plated with solder. However, the shield ring 24 can be constructed from any highly conductive material. The solder 36 (FIG. 1) is melted to bond the shield ring 24 and shields 20 to ensure that a good electrical connection is obtained around the entire circumference 31 of each of the shields 20 (FIG. 3). With the shields 20 engaging the shield ring 24, electrical emissions are not permitted to escape past the shield ring 24.

The shield ring 24 provides an outer periphery 30. A conductive wrap 34 engages the outer periphery 30 and an outer surface 32 of the connector 14. In one example, the connector 14 includes a conductive plating, such as electroless nickel, on its exterior to ensure an electrical connection between the shield ring 24 and the connector 14. In one example, the wrap conductive 34 is a conductive heat shrink wrap such as those available from Methode Corporation or ABK. One type of heat shrink wrap has a 2:1 unshrunk to shrunk ratio. An unshrunk conductive heat wrap is shown by the dashed lines in FIG. 1. The outer surface 32 provides sufficient area for the conductive wrap 34 to be secured, in the example shown. The conductive wrap 34 extends from the connector 14 to the jacket 22, in the example shown.

The shield ring 24 entirely surrounds each of the shields 20 to ensure engagement and an electrical connection therewith. The conductive wrap 34 entirely surrounds and engages the shield ring 24 and the connector 14 to engage and electrically connect the connector 14 to the shield ring 24. In this manner, each of the shields 20 are entirely surrounded by conductive material to prevent emissions from the cable assembly 10.

To manufacture the cable assembly 10 shown in the example, the conductive wrap 34 is slid over the cables 12. The cables 12 are inserted into the holes 26 with the shields 20 exposed and engaging the shield ring 24. The wires 18 are connected to the connector 14. The shield 20 is secured to the shield ring 24, such as by soldering the shields 20 to the shield ring 24. The conductive wrap 34 is secured to the shield ring and the conductor 14. In the example shown, the conductive wrap 34 is shrunk using heat so that it engages the outer periphery 30 of the shield ring 24 and the connector 14. Alternatively or additionally, cable ties, or a similar device, can be arranged around the conductive wrap 34 exteriorly of the outer surface 32 and/or the outer periphery 30 to force the conductive wrap 34 into engagement with them.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An electrical cable assembly comprising:

multiple cables having wires, the cables each having a shield;

a connector receiving ends of the wires and including an outer surface;

a conductive shield ring having an outer periphery and multiple holes receiving the cables, the shield of each cable engaging an inner surface provided by a corresponding hole; and a conductive wrap engaging the outer periphery and the outer surface and electrically connecting the connector to the shields.

2. The electrical cable assembly according to claim 1, wherein the shield includes a circumference and the shield ring engages substantially all of the circumference.

3. The electrical cable assembly according to claim 2, wherein the shield ring engages the entire circumference.

4. The electrical cable assembly according to claim 3, wherein solder secures the shield to the inner surface of the shield ring.

5. The electrical cable assembly according to claim 1, wherein the conductive wrap engages the entire outer periphery of the shield ring.

6. The electrical cable assembly according to claim 5, wherein the conductive wrap is a conductive heat shrink wrap material.

7. The electrical cable assembly according to claim 1, wherein the cables include a non-conductive jacket surrounding the shield, and the wrap overlaps the jacket.

8. The electrical assembly according to claim 7, wherein the cables are entirely shielded from the jacket to the ends with the connector, the conductive wrap, and the shield.

9. A method of manufacturing a cable assembly comprising the steps of:

a) providing multiple cables having wires surrounded by a shield;

b) inserting each cable into a corresponding hole in a conductive shield ring;

c) electrically connecting the shield of each cable to the conductive shield ring; and d) electrically connecting the conductive shield ring to a connector.

10. The method according to claim 9, wherein step c) includes soldering the shield to the shield ring.

11. The method according to claim 9, including the step of inserting ends of the wires into the connector prior to performing step d).

12. The method according to claim 9, wherein step d) includes wrapping a conductive material around the shield ring and the connector.

13. The method according to claim 12, wherein step d) includes securing the conductive material to the connector.

14. The method according to claim 13, wherein step d) includes heat shrinking a conductive wrap to the shield ring and the connector.

* * * * *